US010258830B2

(12) United States Patent
Bonfanti

(10) Patent No.: US 10,258,830 B2
(45) Date of Patent: Apr. 16, 2019

(54) FIN FOR SWIMMING AND UNDERWATER ACTIVITIES

(71) Applicant: C4 S.A.S. DI MARCO BONFANTI & C., Olginate (IT)

(72) Inventor: Marco Bonfanti, Calolziocorte (IT)

(73) Assignee: C4 S.A.S. DI MARCO BONFANTI & C., Olginate (IT)

( * ) Notice: Subject to any disclaimer, the term of this patent is extended or adjusted under 35 U.S.C. 154(b) by 0 days.

(21) Appl. No.: 15/725,247

(22) Filed: Oct. 4, 2017

(65) Prior Publication Data

US 2018/0099187 A1 Apr. 12, 2018

(30) Foreign Application Priority Data

Oct. 6, 2016 (IT) ..... 102016000100150

(51) Int. Cl.
*A63B 31/11* (2006.01)

(52) U.S. Cl.
CPC ..... *A63B 31/11* (2013.01); *A63B 2031/115* (2013.01); *A63B 2208/03* (2013.01); *A63B 2209/00* (2013.01); *A63B 2209/02* (2013.01); *A63B 2225/09* (2013.01)

(58) Field of Classification Search
CPC ..... A63B 31/11; A63B 2031/115; A63B 2208/03; A63B 2209/02; A63B 2209/00
USPC ..... 441/64
See application file for complete search history.

(56) References Cited

U.S. PATENT DOCUMENTS 5,041,039 A * 8/1991 Chang ..... A63B 31/11 36/8.1
6,371,821 B1 * 4/2002 McCarthy ..... A63B 31/11 441/64
8,376,796 B1 * 2/2013 Vock ..... A63B 31/11 441/64
2001/0044246 A1 * 11/2001 McCarthy ..... A63B 31/11 441/64
2009/0137166 A1 * 5/2009 Melius ..... A63B 31/11 441/64
2013/0059492 A1 * 3/2013 Ortwig ..... A43B 5/08 441/64
2018/0099187 A1 * 4/2018 Bonfanti ..... A63B 31/11

FOREIGN PATENT DOCUMENTS

EP 1389483 A1 2/2004
LU 49171 A1 1/1967

OTHER PUBLICATIONS

IT Search Report Written Opinion dated Jul. 21, 2017 re: Application No. IT 201600100150; pp. 1-2; citing: LU 49 171 A1, U.S. Pat. No. 8,376,796 B1, EP 1 389 483 A1 and U.S. Pat. No. 5,041,039 A.

* cited by examiner

*Primary Examiner* — Lars A Olson
*Assistant Examiner* — Jovon E Hayes
(74) *Attorney, Agent, or Firm* — Cantor Colburn LLP

(57) ABSTRACT

A fin for swimming and underwater activities includes at least one foot pocket configured to accommodate the foot of a user and at least one blade associated rigidly with the foot pocket. The fin further includes a substantially spherical joint interposed between the blade and the foot pocket. An upper portion of the joint is rigidly coupled to the base of the foot pocket; and a lower portion of the joint is rigidly coupled to the blade in a portion that is proximate to a respective first end. The joint is lockable in a plurality of different configurations and introduces at least two degrees of rotational freedom.

9 Claims, 7 Drawing Sheets

FIN FOR SWIMMING AND UNDERWATER ACTIVITIES

CROSS-REFERENCE TO RELATED APPLICATIONS

This application claims priority to Italian Patent Application No. 102016000100150, filed on Oct. 6, 2016, the contents of which are herein incorporated by reference in their entirety.

TECHNICAL FIELD

The present disclosure relates to a fin (or more correctly a pair of fins) for swimming and underwater activities.

BACKGROUND

In order to facilitate the movement of underwater swimmers and to increase their speed, the solution universally adopted is to increase the surface of the elements that propel the swimmer: the feet.

The choice to use footwear that offers an extensive flat surface (substantially a flexible inclined plane, suitably connected to the foot) is therefore the most widespread.

The fin is comprised of a part into which the foot is to be inserted (known as the foot pocket) and a flat part the mechanical behavior of which entails propulsion (known as the blade). The blade bends owing to the movement of the foot (kick) and to the drag of the water.

The blade of a fin is made of materials that enable the best elastic response to stresses, thus ensuring a bending with the minimum absorption of energy.

The use is known of materials with excellent elastic response (such as for example composite materials that comprise, for example, reinforcement fibers made of glass, carbon, Kevlar and the like) in order to provide particularly efficient blades.

It has been found that the main problem that can be ascribed to conventional fins derives from the type of coupling between the fin and the foot of the user.

Italian patent no. 1352847, of this same Applicant, clearly explains a technical solution that is intended to provide a more effective coupling between the foot of the user and the fin.

The solution proposed in such patent makes it possible to generate a rigid coupling between the blade and the foot which takes account of the ergonomics and of the true mechanical analysis of the fin-kick.

Such result has been obtained by precisely localizing the area for coupling the blade to the foot (and in particular the area through which the foot transfers the thrust to the blade) and producing a foot pocket that minimizes the energy wastage (and which therefore is coupled in the best possible fashion to the foot of the user).

However, it must be noted that a series of factors of an anatomical and physiological nature make it impossible to provide a fin that can ensure an excellent efficiency for every user.

Structural factors of the user, such as bone structure, musculature, joint mobility, and factors linked to the experience and ability of that user, such as fin-kick technique, can very considerably modify the efficiency of a fin and the possibility of minimizing the energy wastage that arises during the athletic movement of the fin-kick.

For this reason, all conventional fins (including the one illustrated in U.S. Pat. No. 1,352,847) do not ensure the user can take best advantage of their athletic, muscular and anatomical potentials.

SUMMARY

The aim of the present disclosure is to solve the above mentioned drawbacks, by providing a fin for swimming and underwater activities that ensures a mechanical coupling with the foot of the user that offers a high energy yield, while minimizing wastage.

Within this aim, the disclosure provides a fin for swimming and underwater activities that stimulates the foot, the joints and the muscles of the user by following the ideal directions from an anatomical and ergonomic point of view.

The disclosure further provides a fin for swimming and underwater activities that is particularly comfortable for the user.

The disclosure also provides a fin for swimming and underwater activities that does not tire the user even after many hours of use.

The present disclosure provides a fin for swimming and underwater activities which is low cost, easily and practically implemented, and safe in use.

These advantages which will become better apparent hereinafter are achieved by providing a fin for swimming and underwater activities of the type comprising at least one foot pocket adapted to accommodate the foot of a user and at least one blade associated rigidly with said foot pocket, characterized in that a substantially spherical joint is interposed between said blade and said foot pocket, an upper portion of said joint being rigidly coupled to the base of said foot pocket, a lower portion of said joint being rigidly coupled to said blade in a portion that is proximate to a respective first end, said spherical joint being lockable in a plurality of different configurations and introducing at least two degrees of rotational freedom between the blade and the foot pocket.

BRIEF DESCRIPTION OF THE DRAWINGS

Further characteristics and advantages of the disclosure will become better apparent from the detailed description that follows of a preferred, but not exclusive, embodiment of the fin for swimming and underwater activities according to the disclosure, which is illustrated by way of non-limiting example in the accompanying drawings, wherein.

DETAILED DESCRIPTION OF THE DRAWINGS

Figure 1:
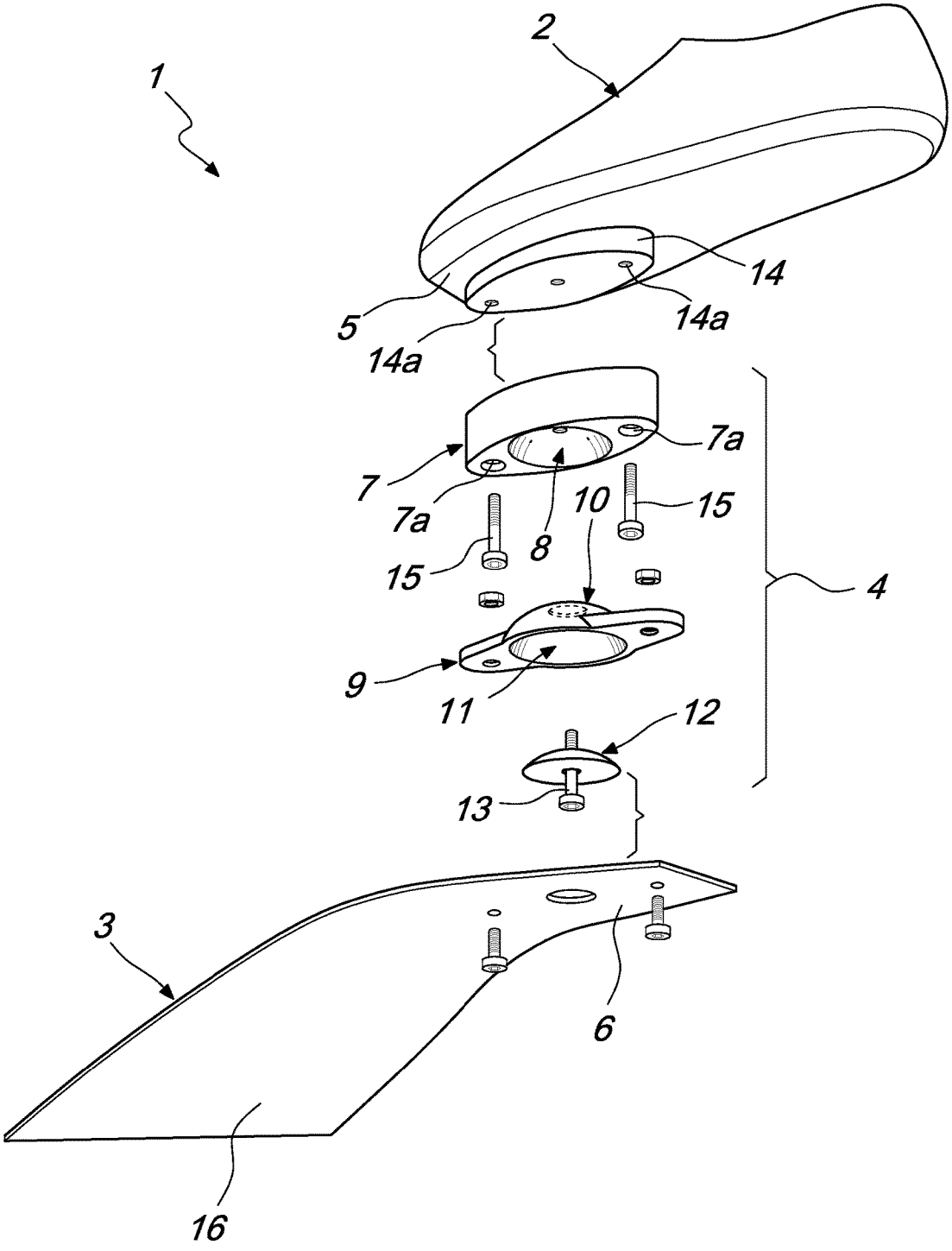
FIG. 1 is an exploded perspective view of a fin for swimming and underwater activities according to the disclosure.
Figure 2:
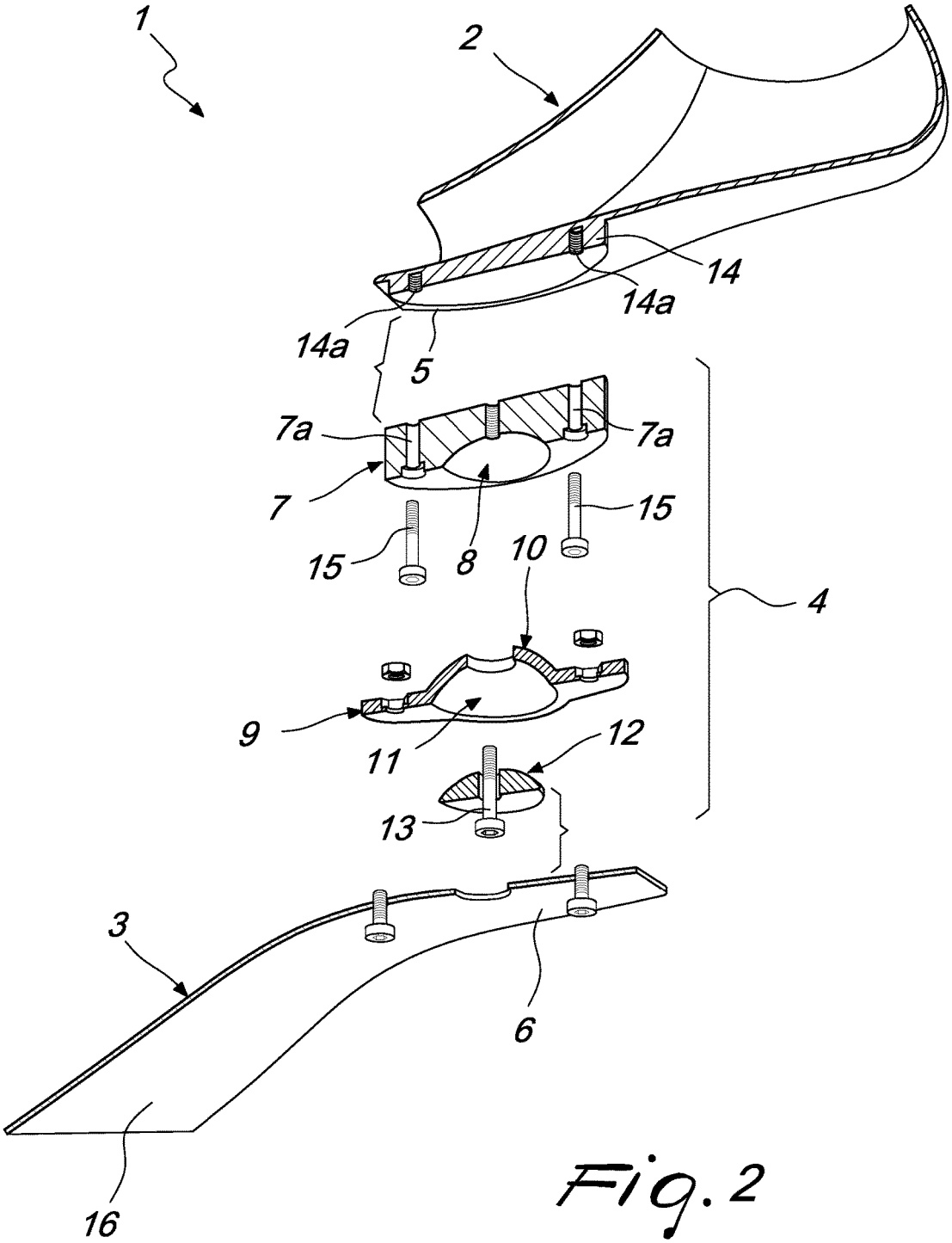
FIG. 2 is a cross-sectional exploded perspective view, taken along a center longitudinal plane, of the fin in FIG. 1.
Figure 3:
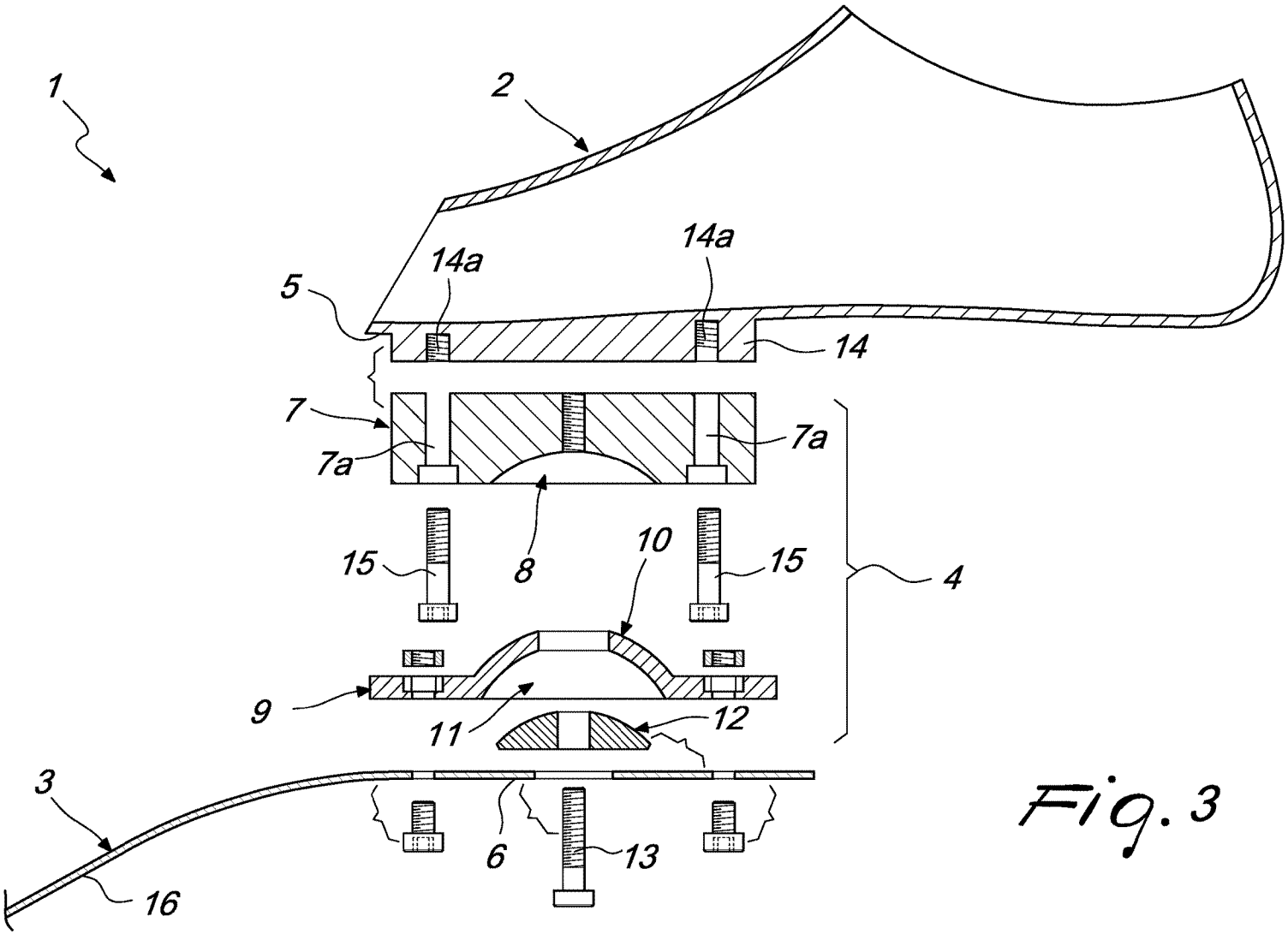
FIG. 3 is a cross-sectional exploded side view, taken along a center longitudinal plane, of the fin in FIG. 1.
Figure 4:
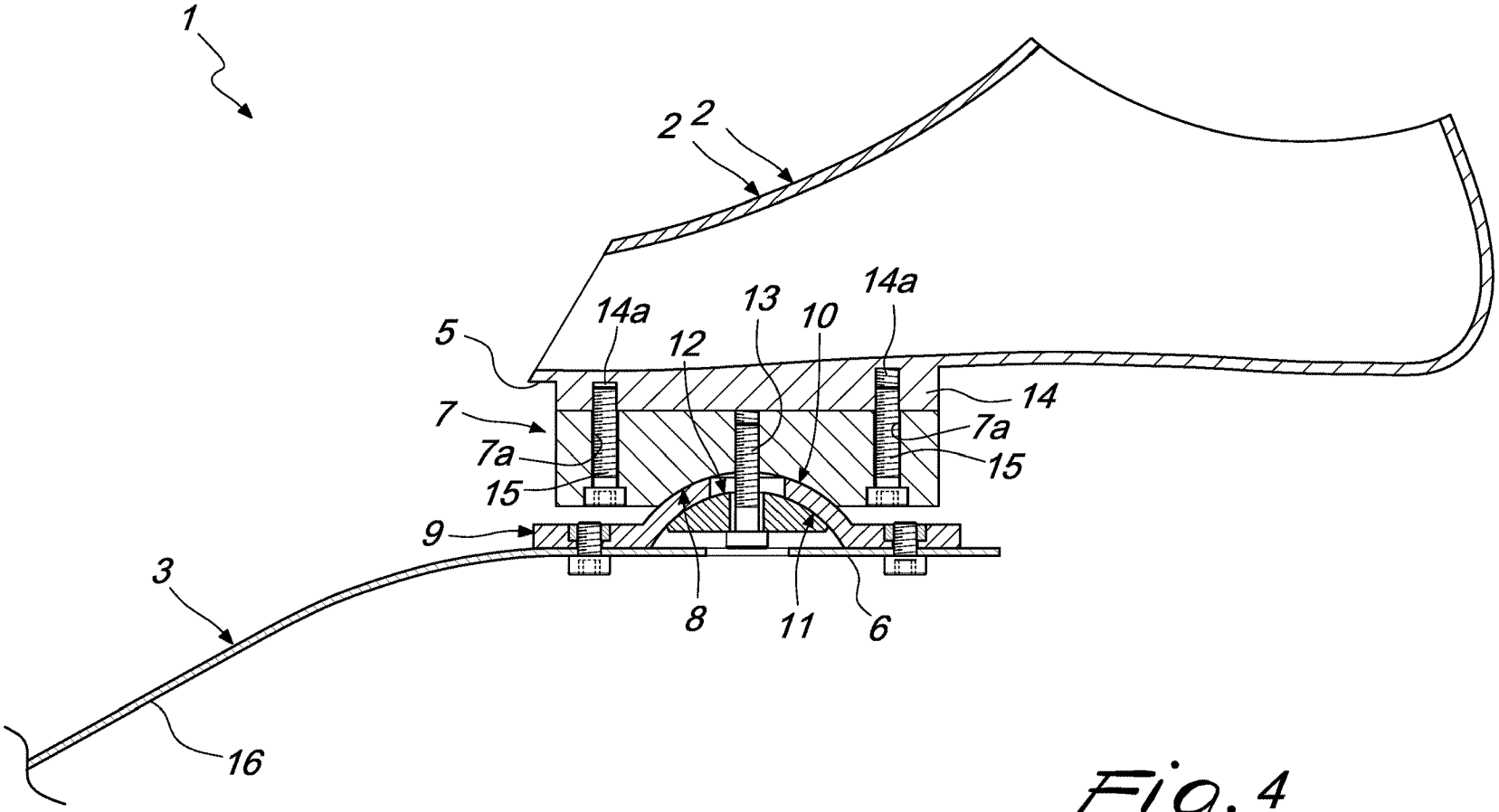
FIG. 4 is a cross-sectional side view, taken along a center longitudinal plane, of the fin in FIG. 1 in a first configuration of alignment between the blade and the foot pocket, defined according to a first rotation axis.
Figure 5:
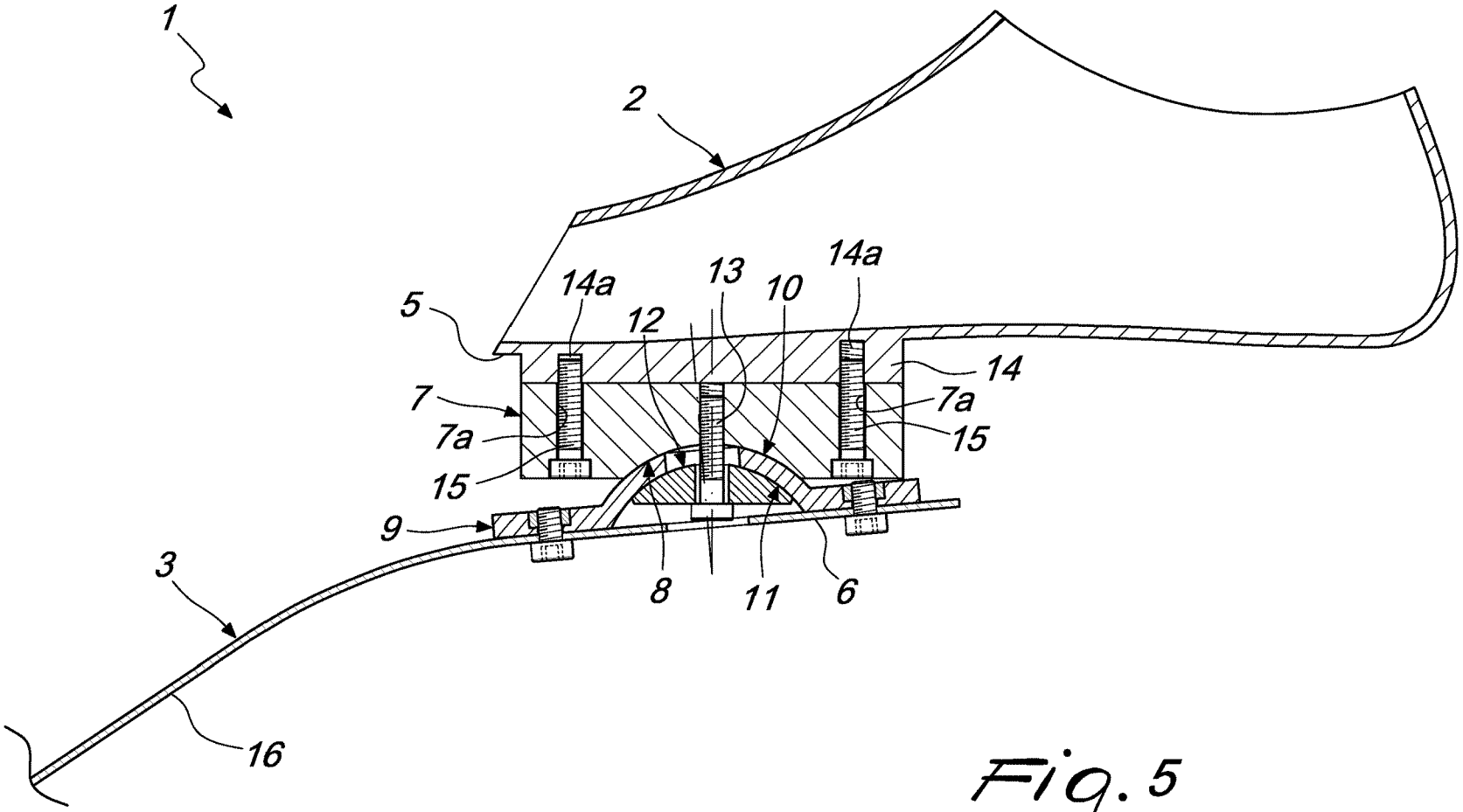
FIG. 5 is a cross-sectional side view, taken along a center longitudinal plane, of the fin in FIG. 1 in a second configuration of alignment between the blade and the foot pocket, defined according to a first rotation axis.
Figure 6:
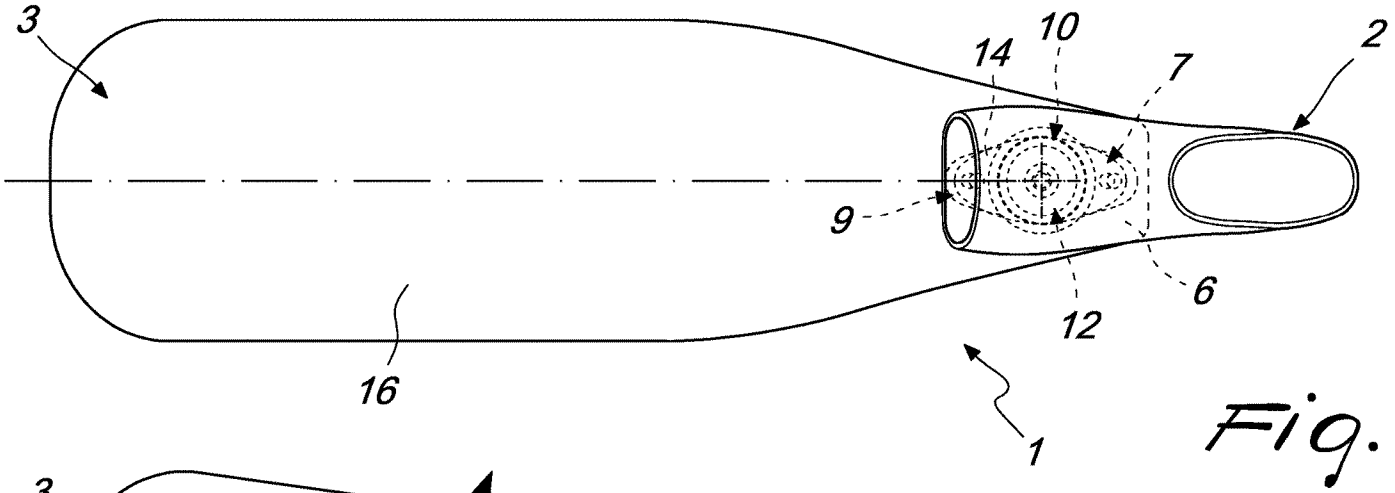
FIG. 6 is a plan view of the fin in FIG. 1.
Figure 7:
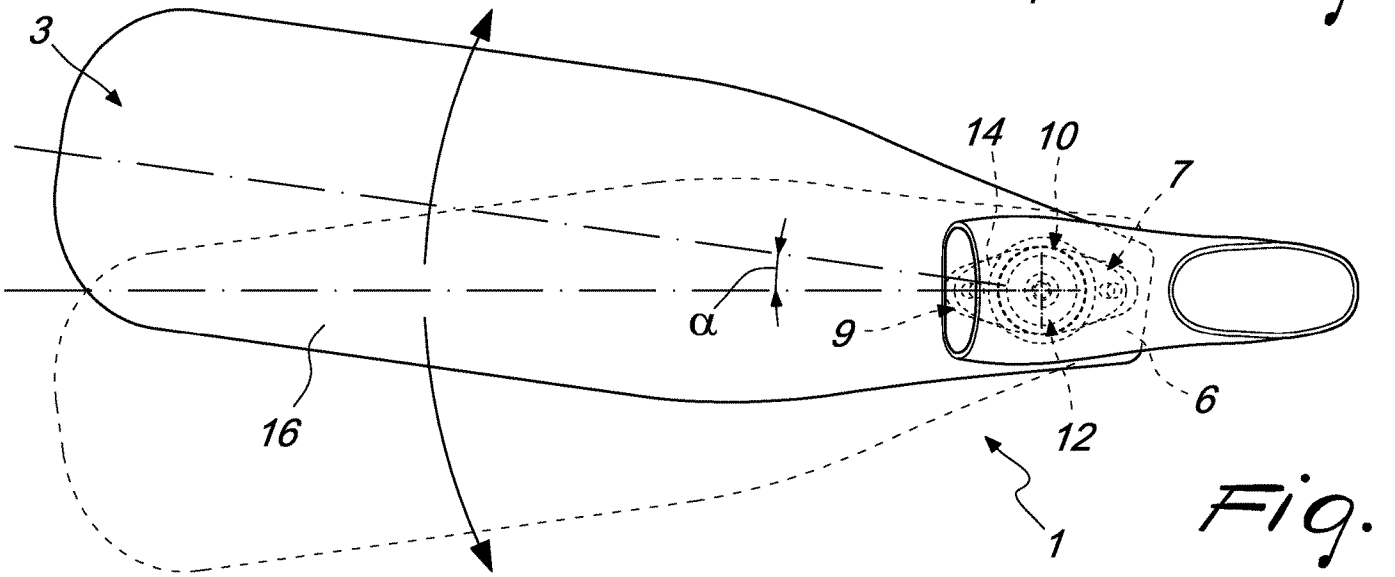
FIG. 7 is a plan view of the fin in FIG. 6 showing the limit configuration that the blade can assume according to a second rotation axis.
Figure 8:
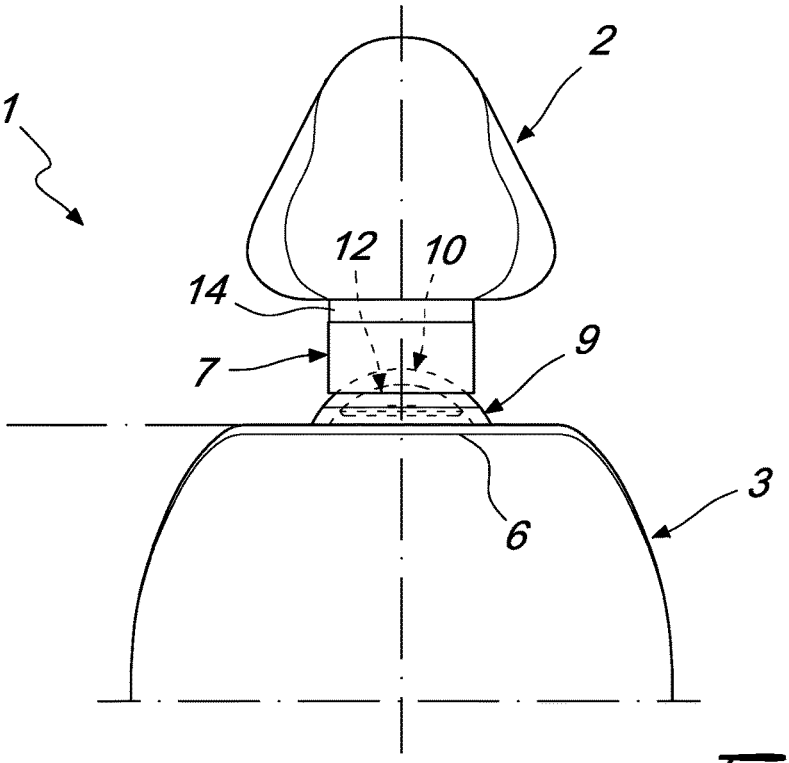
FIG. 8 is a rear view of the fin in FIG. 1.
Figure 9:
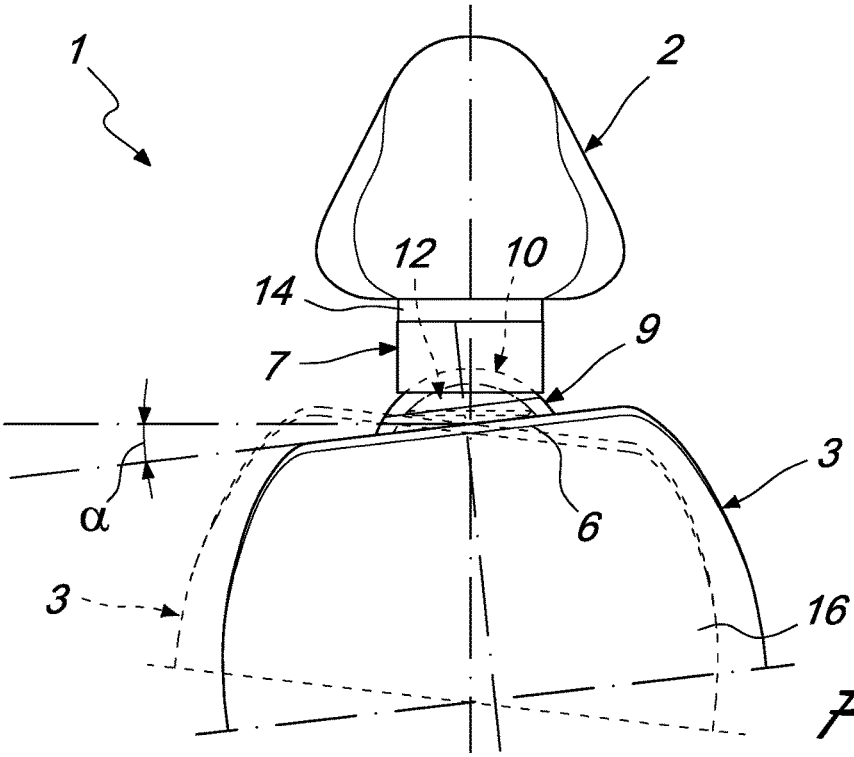
FIG. 9 is a rear view of the fin in FIG. 8 showing the limit configuration that the blade can assume according to a third rotation axis.

With reference to the figures, a fin for swimming and underwater activities is generally designated by the reference numeral 1.

The fin 1 comprises at least one foot pocket 2 that is adapted to accommodate the foot of a user and at least one blade 3 that is rigidly associated with the foot pocket 2 (optionally also with the interposition of washers, laminas and other components for adjusting the overall thickness).

With particular reference to the innovative elements that identify the fin 1 according to the disclosure, it should be noted that a substantially spherical joint 4 is interposed between the blade 3 and the foot pocket 2.

An upper portion of the joint 4 is rigidly coupled to the base 5 of the foot pocket 2, at the corresponding part designed to accommodate the articulated region between the metatarsus and the bones of the digits of the foot.

The possibility of providing different versions of the present disclosure in which the upper portion of the joint 4 is coupled to the base 5 of the foot pocket 2 in a cantilever manner (at the front or at the rear) or to the heel or to the plantar arch region is not ruled out.

A lower portion of the joint 4 is rigidly coupled to the blade 3 in a portion 6 that is proximate to a respective first end.

In this case too, the interposition between the lower portion of the joint and the respective blade 3 of components intended to vary the thickness of their join (more correctly, the mutual distance) is not ruled out.

The spherical joint 4 is lockable in a plurality of different configurations and introduces at least two degrees of rotational freedom between the blade 3 and the foot pocket 2.

In essence, when the spherical joint 4 is not locked, the blade 3 can rotate with respect to the foot pocket 2, changing the mutual inclination between the base 5 of the foot pocket 3 and the portion 6 of the blade 3 and varying the direction of the longitudinal axis of the blade 3 with respect to the longitudinal axis of the foot pocket 2.

The interposition of the spherical joint 4 makes it possible to immobilize the blade 3 with respect to the foot pocket 2 so as to ensure an ideal alignment of the blade 3 with the body of the user (in particular with the projection of the user's center of gravity) and, in such condition, it ensures that the blades 3 (when the legs are still, at rest) are mutually co-planar.

This favors the efficiency of the fin-kick and makes it possible to stimulate the skeletal apparatus, the muscular apparatus and the joints, in total keeping with the anatomical structure of the user, and therefore to full ergonomic advantage.

It should be noted that, in the present discussion, the term "substantially spherical joint" 4 comprises any joint that introduces at least two degrees of freedom between the foot pocket 2 and the blade 3, independently of the shape structure thereof.

The spherical joint 4 comprises, in turn, an upper shell 7 which constitutes the upper portion of the joint 4, which is coupled to the base 5 of the foot pocket 2.

The upper shell 7 comprises, on the surface that lies opposite the surface that is coupled to the base of the foot pocket 2, a cavity 8 with a substantially spherical shape.

The spherical joint 4 further comprises a lower shell 9 which constitutes the lower portion of the joint 4 which is coupled to the blade 3 in a portion 6 proximate to a corresponding end.

The lower shell 9 comprises, on its upper face, a protruding dome 10 with shape and dimensions substantially complementary to those of the cavity 8 and, on its lower face, a recess 11 with a substantially spherical shape.

The spherical joint 4 comprises a block 12 the shape and dimensions of which are complementary to those of the recess 11 and which can be accommodated therein.

There is at least one retention element 13 that passes through the block 12 and engages stably in the upper shell 7 with consequent fastening, and clamping, of the lower shell 9 between the block 12 and the upper shell 7.

The possibility of interposing, between the upper shell 7 and the lower shell 9, components that facilitate the coupling thereof when the retention element 13 is fastened, such as for example a washer, an elastic washer, a toothed washer and the like is not ruled out.

By making the two shells 7 and 9 of deformable material (such as for example a polymeric material) the fastening of the retention element 13 causes the penetration of portions of the interposed component into the surface of the cavity 8 and into the surface of the dome 10 with consequent mutual locking.

With particular reference to an embodiment of undoubted practical and applicative interest, the base 5 of the foot pocket 2, at the corresponding part designed to accommodate the articulated region between the metatarsus and the bones of the digits of the foot, comprises an anchoring support 14 for retaining the upper shell 7.

The upper shell 7 can therefore be coupled to the anchoring support 14 by way of units such as screws 15, rivets and the like.

However, the possibility is not ruled out of making the upper shell 7 in a single piece with the sole 5 of the foot pocket 2: in essence, during the step of molding the foot pocket 2 the upper shell 7 (integral with the rigid sole 5) will be arranged so that they are correctly covered with the deformable polymeric material that will constitute the covering and the upper of the foot pocket 2.

To this end the shell 7 and the support 14 will comprise respective holes 7*a* and 14*a* for stably accommodating the screws 15.

The holes 7*a* and 14*a* can be through holes (in such case the tightening elements will be bolts) or threaded holes (in such case the shell 7 and the support 14 will be made of high mechanical strength material, resistant to deformations). Alternatively, it should be noted that the holes 7*a* and 14*a* can be internally smooth, with a diameter substantially smaller (at most similar) than the diameter of the screws 15: in this case, the screws 15 will be self-tapping and the ridge of their threading will directly "bite" the material that constitutes the shell 7 and the support 14 (which in this case can have less rigidity than that necessary if the holes 7*a* and 14*a* are threaded, as described previously).

It should further be noted that, according to a possible variation of undoubted applicative interest, the foot pocket 2 is made of deformable polymeric material.

The softness of the foot pocket 2 can be such as to not permit an optimal transfer of energy from the foot to the blade 2: for this reason the foot pocket 2 comprises an insole made of substantially rigid material (not visible in the accompanying figures) that is integral with the anchoring support 14.

The rigid insole can be inserted into the foot pocket 2 or, more efficiently in terms of increasing the overall rigidity of the foot pocket 2, it can be inserted during the molding of the foot pocket 2 proper.

In fact, by overmolding the foot pocket 2 on the insole it is possible to define the layer of material for covering the insole as a function of the specific requirements for mechanical coupling with the support 14 and for user comfort.

The possibility that the manufacture of the foot pocket 2 (with insole incorporated) can be carried out with a co-molding operation is not ruled out (adopting materials with different mechanical characteristics for the two components).

It should further be noted that the blade 3 is made of a material chosen preferably from either composite and polymeric.

The choice of material depends on the elastic response that is required of the blade 3: using polymeric material will not result in a rapid elastic return by the blade 3, but it will have quite a low cost; blades 3 made of composite material, on the other hand, ensure a rapid elastic return that facilitates the fin-kick.

According to the type of composite, the costs can vary from a minimum value, characteristic of using fiberglass as a reinforcing agent, to a maximum value, characteristic of some particular carbon fibers. Other kinds of fibers are not currently effectively applied in the production of blades 3 for fins, although their future use is not ruled out.

The blade 3 comprises two portions 6 and 16, which are mutually inclined and generated without discontinuities.

A first portion 6, proximate to a respective first end, has maximum thickness and rigidity and is coupled to the base 5 of the foot pocket 2.

A second portion 16 on the other hand has a thickness and rigidity that decrease starting from the connection with the first portion 6 up to the second end of the blade 3, protruding in a cantilever manner with respect to the foot pocket 2.

However, the possibility of providing completely flat blades 3 is not ruled out, in which the correct alignment between these and the direction of motion desired by the underwater user is ensured by the joint 4.

The fin 1 described above requires a preliminary setting step that makes it possible to take best advantage of the potential for adjustment offered by the presence of the spherical joint 4.

In fact, the anatomical structure and the joint mobility of the user are such as to make it substantially impossible that, with traditional fins, when the user is dangling vertically and the weight of the fins bears on the lower limbs of the user, the blades will be mutually co-planar, their axis of symmetry will be parallel, and such axis will be aligned with the projection of the center of gravity of the user. It should be noted that also, differences can usually be found between the right leg and the left leg of a same user that do not allow to carry out an alignment.

All these misalignments imply a considerable wastage of energy during the fin-kick, in that part of the thrust of the blades is in a direction that is not aligned with the desired direction of underwater motion, and part of the muscular energy is wasted owing to attrition, hydrodynamic resistance, and the mechanical plays present.

The method of configuring fins 1 entails a sequence of steps that the user has to be subjected to for the correct setting (i.e. for the correct alignment of the blades by way of the substantially spherical joint 4).

Firstly, it is necessary to couple the upper shell 7 to the anchoring support of the base 5 of the foot pocket 2.

Subsequently, it is necessary to couple the lower shell 9 to a plate provided with respective coupling holes.

The plate is not shown in the accompanying figures; it is an accessory that is used only during the step of preliminary configuration of the fins 1.

The plate can be made of polymeric material, of metal, of wood, of composite material or of another material.

It will need to comprise a plurality of holes, corresponding to the holes present in the portion 6 of the blades 3, in order to be capable of being correctly coupled to both of the lower shells 9 of the two fins 1.

Then it is necessary for the user to don the foot pocket 2 and dangle their lower limbs slackly and with the feet at a distance from the ground that is greater than the length of the plate.

At this point, it will be possible to loosely couple the block 12 (interposed between the plate and the lower shell 9) to the upper shell 7 by way of a fastening screw 13 and leave the plate hanging from the foot pocket 2.

Once a stable arrangement of the blade 3 with respect to the foot pocket 2 has been assumed (i.e. once any oscillations owing to the fact that the user is dangling with their legs slack have ceased), the screw 13 needs to be tightened in order to immobilize the spherical joint 4.

Then the plate can be removed from the lower shell 7 of the spherical joint 4, and the lower shell 9 of the spherical joint 4 can be coupled to the portion 6 of the blade 3.

It should be noted that it is possible to force the assumption of a position of correct alignment by also carrying out an intermediate step.

In fact, after the step of loosely coupling the block 12 to the upper shell 7 and before the step of tightening the screw 13 in order to lock the spherical joint 4, the temporary coupling of a ballast to the plate is provided in order to facilitate, by way of the traction produced by the ballast, the correct alignment of the lower shell 9 with the upper shell 7 in the spherical joint 4.

It should further be noted that the plate is adapted to couple lower shells 9 that are associable with two foot pockets 2 simultaneously, in order to determine the co-planar arrangement of such lower shells 9 of the respective joints 4; such configuration corresponds to the co-planar arrangement of the portions 16 that protrude from the foot pocket 2 in the configuration of use of the fins 1.

It should be noted that the presence of the joint 4 makes it possible to provide an ideal alignment and an ideal positioning of the two blades 3, mutually and with respect to the user, and it also offers great versatility of use.

In fact, a user who has adjusted (calibrated) the joints 4 of their fins 1 can, at any time, uncouple the blades 3 from the respective joints 4 and substitute these blades with other blades 3 that have different characteristics (made of a different material and/or having different elastic response and/or having different dimensions) or with a single (double) blade in order to provide a mono-fin.

However, in all these cases the user will always be in the conditions for ideal alignment of the portion 16 of the blades 3, both mutually and with respect to the anatomic parameters of the user.

Advantageously the present disclosure solves the above mentioned problems, by providing a fin 1 for swimming and underwater activities that ensures a mechanical coupling with the foot of the user that offers a high energy yield, while minimizing wastage.

Conveniently, the fin 1 according to the disclosure stimulates the foot, the joints and the muscles of the user by following the ideal directions from an anatomical and ergonomic point of view.

Conveniently, the fin 1 according to the disclosure is particularly convenient for the user in that their lower limbs are not stimulated in a misaligned manner.

Positively, the fin 1 according to the disclosure does not tire the user even after many hours of use.

Positively, the fin 1 for swimming and underwater activities is easily and practically implemented and is low cost: such characteristics make the fin 1 an innovation that is certain to be safe in use.

The disclosure, thus conceived, is susceptible of numerous modifications and variations. Moreover, all the details may be substituted by other, technically equivalent elements.

In particular it should be noted that it is possible to make upper shells 7 of different height, or to interpose spacers between the shell 7 and the support 14: this facility makes it possible to adjust the distance between the blade 3 and the base 5 of the foot pocket 2. This adjustment ensures it is possible to modify the lever arm present between the foot of the user and the blade 3, thus varying the possible configurations until the one of best performance for the user is identified.

Similarly, the possibility of adopting additional fixing elements is not ruled out for the stable immobilization of the spherical joint once the corresponding adjustment has been carried out. For example, there could be screws (preferably self-tapping) arranged transversely, which pass through the various components of the shell 4, rendering them mutually integral.

In the embodiments illustrated, individual characteristics shown in relation to specific examples may in reality be interchanged with other, different characteristics, existing in other embodiments.

What is claimed is:

1. A fin for swimming and underwater activities comprises at least one foot pocket configured to accommodate a foot of a user and at least one blade associated rigidly with said foot pocket, wherein a substantially spherical joint is interposed between said blade and said foot pocket, an upper portion of said joint being rigidly coupled to the base of said foot pocket, a lower portion of said joint being rigidly coupled to said blade in a portion that is proximate to a respective first end, said joint being lockable in a plurality of different configurations and introducing at least two degrees of rotational freedom between the blade and the foot pocket, wherein said blade is made of a material chosen from either composite and polymeric and comprises two mutually inclined portions generated without discontinuities, a first portion, proximate to a respective first end, which has maximum thickness and rigidity, being coupled to the base of said foot pocket, and a second portion, the thickness and rigidity of which decrease from the connection with said first portion to the second end of said blade, protruding in a cantilever manner with respect to said foot pocket.

2. The fin according to claim 1, wherein said substantially spherical joint comprises an upper shell that constitutes said upper portion of said joint which is coupled to the base of said foot pocket, said upper shell comprising, on the surface that lies opposite the surface that is coupled to said base of said foot pocket, a cavity with a substantially spherical shape.

3. The fin according to claim 2, wherein said substantially spherical joint comprises a lower shell that constitutes said lower portion of said joint which is coupled to said blade in a portion that is proximate to a respective end, said lower shell comprising, on its upper face, a protruding dome the shape and dimensions of which are substantially complementary to those of said cavity and, on its lower face, a recess with a substantially spherical shape.

4. The fin according to claim 3, wherein said spherical joint comprises a block the shape and dimensions of which are complementary to those of said recess and which can be accommodated therein, at least one retention element passing through said block and engaging stably in said upper shell, with consequent fastening and clamping of said lower shell between said block and said upper shell.

5. The fin according to claim 2, wherein said base of said foot pocket, at the corresponding part designed to accommodate the articulated region between the metatarsus and the bones of the digits of the foot, comprises an anchoring support for the retention of said upper shell, said upper shell being coupled to said anchoring support by way of units.

6. The fin according to claim 5, wherein said foot pocket is made of deformable polymeric material and comprises an insole made of substantially rigid material that is integral with said anchoring support.

7. A method of configuring fins according to claim 1, the method including the following steps:

- coupling the upper shell to the anchoring support of said base of said foot pocket;
- coupling the lower shell to a plate provided with respective coupling holes;
- donning said foot pocket and dangling the lower limbs slackly and with the feet at a distance from the ground that is greater than the length of the plate;
- loosely coupling said block to said upper shell by way of a fastening screw and leaving the plate hanging from the foot pocket;
- once a stable arrangement of said blade with respect to said foot pocket has been assumed, tightening said fastening screw in order to lock said substantially spherical joint;
- removing said plate from said lower shell of said substantially spherical joint; and
- coupling said lower shell of said substantially spherical joint to said portion that is proximate to a first end of said blade.

8. The method according to claim 7, wherein, after the step of loosely coupling said block to said upper shell and before the step of tightening said screw in order to lock said substantially spherical joint, there is a temporary coupling of a ballast to said plate in order to facilitate, by way of the traction produced by said ballast, the correct alignment of the lower shell with the upper shell in the substantially spherical joint.

9. The method according to claim 7, wherein said plate is adapted to couple lower shells that correspond to two foot pockets simultaneously in order to determine the co-planar arrangement of said lower shells of the corresponding joints, which corresponds to the co-planar arrangement of the portions that protrude from said foot pocket in the configuration of use of said fins.

* * * * *